United States Patent [19]

Noren

[11] 4,431,015

[45] Feb. 14, 1984

[54] GLASS WASHER AND STERILIZER

[76] Inventor: Tore H. Noren, Box 219, Petaluma, Calif. 94952

[21] Appl. No.: 319,637

[22] Filed: Jul. 19, 1982

[51] Int. Cl.[3] ..... B08B 3/02

[52] U.S. Cl. ..... 134/55; 134/143; 134/170; 134/186

[58] Field of Search ..... 134/55, 143, 170–171, 134/186, 200

[56] References Cited

U.S. PATENT DOCUMENTS 1,559,727 11/1925 Merseles et al. ..... 134/186 UX 2,063,746 12/1936 Meeker ..... 134/186 X 4,086,929 5/1978 Focht ..... 134/143 X

FOREIGN PATENT DOCUMENTS 355227 10/1905 France ..... 134/55

534991 10/1955 Italy ..... 134/170

*Primary Examiner*—Robert L. Bleutge

*Attorney, Agent, or Firm*—Alvin E. Hendricson

[57] ABSTRACT

A small washer and sterilizer for glasses has a counter-weighted door with a watertight seal without gaskets, a novel overhead spray unit particularly adapted for under bar installation and an improved drainage system.

7 Claims, 7 Drawing Figures

GLASS WASHER AND STERILIZER

BACKGROUND OF INVENTION

The art of commercial dish and glass washing has been materially advanced to the point where most restaurants and bars are equipped with automatic or at least semi-automatic washing machines. Commercial machines are required to operate rapidly and to sterilize the objects placed therein and the present energy shortage has added the requirement of minimizing the amount and temperature of hot water required for each operation. a further requirement of commercial units is longevity and service-free operation in order that the economics of operation are favorable to the owner under high volume useage.

Commercial glass washers commonly employed in soda fountains, bars and the like must normally occupy a minimum of space and should fit under a counter and yet may be called upon to wash and sterilize a large volume of glasses at least during peak business periods. Consequently, it is important that the washer be quite easy to load and unload and operate rapidly so that a large number of successive small loadings may be easily made in a short period of time. The present invention is particularly adapted to the accomplishment of these requirements.

SUMMARY OF INVENTION

The glass washer and sterilizer of this invention has a low profile housing particularly adapted for installation beneath a counter or bar with an inclined front door counterbalanced to readily swing between an open horizontal position and a closed position. A tray for glasses is adapted to slide into a wash and rinse compartment of the washer and to slide out onto the open front door for ready loading and unloading. The door is sealed against water escape by particularly configured interlocking metal elements without gaskets or the like.

An improved drain system is disposed in a sump beneath the wash and rinse compartment and includes a hollow cylindrical solenoid operated valve providing rapid dumping of water from the sump with overflow protection and damping means for valve cylinder travel. An auxiliary tank receives water dumped from the sump and discharges same to a sewer connection at a slower rate for accommodating rapid wash and rinse cycles without overloading the sewer connections.

The present invention also includes an overhead rinse unit having particular mounting and connections facilitating removal and reinsertion without access to the outside of the washer. This materially enhances the capability of the unit for under counter installation.

BRIEF DESCRIPTION OF DRAWINGS

The present invention is illustrated as to a preferred embodiment in the accompanying drawings, wherein.

DESCRIPTION OF PREFERRED EMBODIMENT

Figure 1:
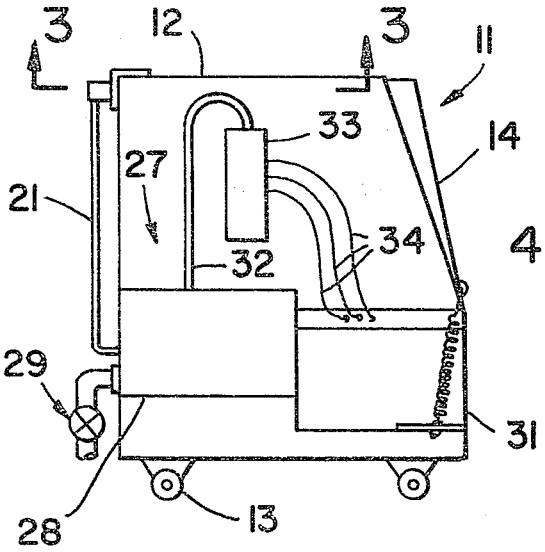
FIG. 1 is a side elevational view of the glass washer of the present invention.

The present invention as illustrated in the accompanying drawings comprises a compact and relatively small sized unit for washing and sterilizing glasses. This unit 11 is adapted to fit under a counter or bar so as to occupy a minimum amount of space in crowded quarters and comprises a cabinet 12 preferrably formed of stainless steel and which may be mounted upon wheels 13 for ready placement of the unit in desired position. The washer of the present invention has many conventional features including the washing and rinsing compartment which is therein accessible from the front of the unit by a pivotally mounted door 14 and which contains a rotating spray arm at the bottom thereof whereby water with appropriate additives may be sprayed upon glasses disposed within the compartment in a tray 16. A suitable pump (not shown) withdraws water from a sump 17 through a pipe 18 at the bottom thereof and forces water through the spray arm (also not shown) and selectively directs rinse water through a pipe 21 to a top spray unit 22, further described below.

Figure 2:
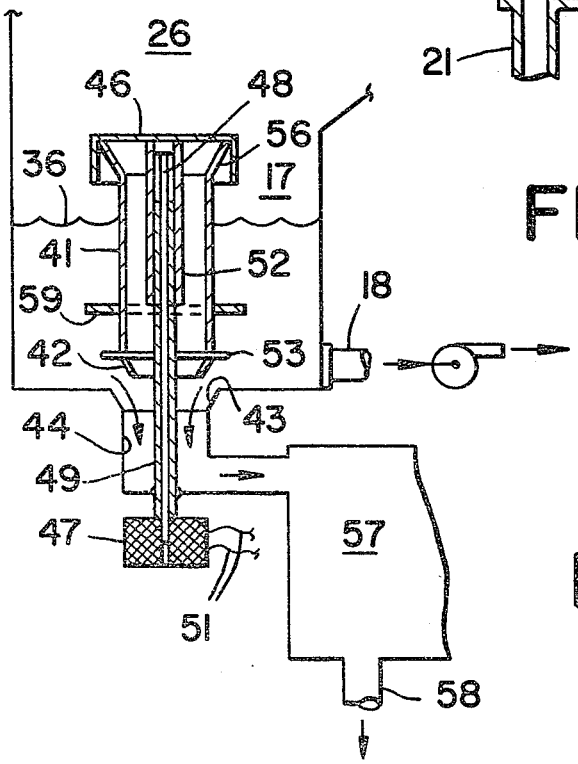
FIG. 2 is a schematic representation partially in vertical section of the drainage system of the washer of FIG. 1.

The glass washer and sterilizer 11 of the present invention includes an improved water discharge unit associated with the sump 17 and illustrated in FIG. 2 of the drawings. Referring now to this figure of the drawings it will be seen that the sump 17 is disposed below a wash and rinse compartment 26 which is adapted to receive water fed therein through an inlet system 27 including a heating tank 28 connected to a water source through an inlet line and valve 29 and which includes a heating element operated by a control system 31. Inlet water in the tank 28 is heated to a predetermined temperature such as 120° F. to 140° F.and thence passed through an inlet tube or line 32 through vacuum breaker 33 to a sump 17 of the washer and sterilizer of the present invention. This manner of inserting water into a washer and the like is disclosed in my copending U.S. patent application Ser. No. 244,603, now U.S. Pat. No. 4,369,806 entitled "VACUUM BREAKER AND MIXING CHAMBER", filed Mar. 17, 1981. The sump of the present invention is located below the washing and rinsing compartment 26 and is adapted to contain water to a level 36 through which there extends a hollow cylinder having at the bottom thereof an inclined surface or inwardly tapering frustoconical portion 42 adapted to mate with a conical surface 43 about a discharge pipe 44 at the bottom of the sump 17. This discharge cylinder 41 is open at the top thereof and is covered by a cap 46 at the upper end thereof as by spaced struts or the like and is adapted to be moved upwardly to open the valve comprised of the valve element 42 and seat 43 by a solenoid 47 having an armature rod 48 extending upwardly through the center of a guide cylinder 49 from beneath the discharge pipe 44 of the sump 17. Energization of the solenoid 47 via wires 51 connected thereto and through the control means 31 to a power supply will force the rod 48 upwardly so that the head thereof engages the underside of the cap 48 to move the hollow cylinder 41 vertically upward to unseat the inclined or conical lower surface of the cylinder 41 from the valve seat 43. Provision is herein made for insuring that water in the sump 17 does not leak down to the solenoid 47 and to this end there is provided a hollow cylinder 52 which is secured to the underside of the cap 46 and depends therefrom in slidably mating relationship with the cylinder 49 about the push rod or solenoid rod 48. The hollow cylinder 69 extends above the normal water level 36 in the sump 17 and furthermore the cylinder 52 extends downwardly well past the top of the hollow cylinder 49 as illustrated in FIG. 2 so that, even though water may ocassionally overflow from the sump 17 about the interior of the cap 46 and into the top of the cylinder 41 so as to be discharged from the sump, there is no possibility of such water entering the system associated with the solenoid rod 48. It is also noted that the tube or cylinder 49 about the solenoid rod 48 is sealed at the passage thereof through the discharge pipe 44 from the sump 17. The hollow cylinder 41 is adapted to seal the discharge pipe 44 until raised by the solenoid 47 through the medium of the rod 48 and this sealing is accomplished by mating of the conical portion 42 of the cylinder with the valve seat 43. In addition, there is provided a sealing ring 53 about the cylinder 41 at the top of the lower conical portion 42 of the cylinder for engaging the floor of the sump 17 about the valve seat 43 in the bottom thereof.

It will be appreciated that the cap 46 is firmly secured to the top of the cylinder 41 by struts 56 so as to leave an opening for water to flow about the cylinder within the cap and over the open top of the cylinder in order to provide an overflow for the sump, even though discharge is not otherwise open. The particular arrangement of the cylinder 52 depending from the cap and slidably engaging the tube 49 of the solenoid rod 48 provides a vertical guide for the cylinder 41 and also prevents water from reaching the solenoid 47.

The large discharge pipe 44 at the bottom of the sump 17 leads to an auxiliary tank 57 adapted to receive water precipitously dumped from the sump 17 through the large discharge pipe 44. This auxiliary tank 57 is in turn connected by a smaller pipe 58 to a sewer line. In this manner it is possible to very rapidly empty the sump 17 and yet not to overload a discharge or sewer line to which the present invention may be connected. Water may more slowly drain from the auxiliary tank 57 while the cycle of operation of the glass washer is continuing.

It is noted that actuation of the solenoid 57 will force the armature rod 48 thereof vertically upward in a rapid fashion. This will cause the head of the rod 48 to strike the underside of the cap 46 on the cylinder 51 to raise the cylinder and open the valve at the bottom thereof. While it is desired to very rapidly open the valve it is also important that the cylinder 41 shall not be driven upwardly out of the water in the sump by the force imparted by the solenoid rod 48 and to this end there is provided a lateral flange 59 about the exterior of the cylinder 41 in spaced relation to the bottom thereof, as particularly illustrated in FIG. 2 of the drawings. This flange or lateral extension of the cylinder 41 will exert a drag on rapid movement of the cylinder in the water in the sump so that the cylinder will not be precipitously driven out of the water when the solenoid is energized.

The above-described discharge arrangement of the present invention is highly advantageous in providing for very rapid dumping of water in the sump 17 so that the valve at the bottom may then be rapidly closed and fresh rinse water delivered from the tank 28 into the sump so that the cycle of operation of the washer may continue while the wash water that has been dumped is slowly draining from the auxiliary tank 57. The arrangement of slidably mating tubes 49 and 52 about the solenoid push rod 48 is also advantageous in preventing any possible leakage of water downward about the rod into the solenoid 47 and, furthermore, the lateral extension of flange 59 about the exterior of the cylinder 41 below the water level 36 in the sump is advantageous in damping the movement of the cylinder when stuck by the solenoid rod.

Figure 3:
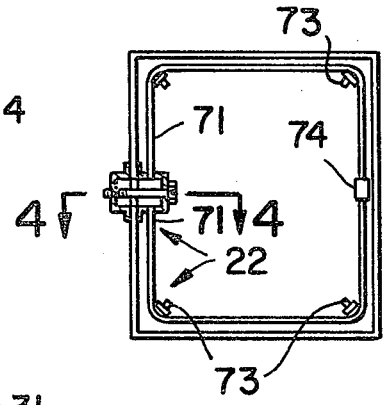
FIG. 3 is a sectional view showing the upper rinse unit and taken in the plane 3—3 of FIG. 1.
Figure 4:
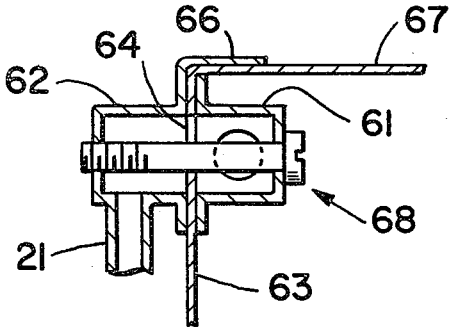
FIG. 4 is a partial sectional view taken in the plane 4—4 of FIG. 3.

The present invention also provides a unique top rinse mechanism which is mounted as a unit within the washing and rinsing chamber of the present invention immediately under the top wall thereof in such a manner that it may be readily removed from the interior of the compartment without access to the back of the washer which is adapted to be disposed beneath a counter so as to be quite inaccessible. This rinse mechanism, as illustrated in FIGS. 3 and 4, includes inner and outer flanged hollow cylinders 61 and 62 disposed on opposite sides of the rear wall 63 of the washer adjacent the top thereof and communicating by an opening 64 in this rear wall. The flanges about the open ends of the cylinders 61 and 62 fit tightly against the inner and outer sides of the back wall 63 of the washer, as shown, and a sealant may be employed in these contacting surfaces to insure a watertight connection. The outer cylinder 62 has a forward extension or a 90° bend 66 at the top of the cylinder flange for extending over the top wall 67 of the washer and bearing thereon in order to fix the vertical position of the cylinder 62 for aligning the open end thereof with the opening 64 in the back wall of the washer. This connecting unit is held in place by a bolt 68 having a head bearing on the inner closed end of the cylinder 61 and extending through the cylinder and through the outer cylinder 62 into threaded engagement with the closed outer end thereof. Tightening of this bolt will thus be seen to draw the cylinders and flanges against the rear wall of the washer in clamping relation to the rear wall of the washer disposed therebetween. Unthreading of the bolt will release the inner cylinder from the outer cylinder so that the spray mechanism connected to the inner cylinder may then be removed from the washer without access to the rear of the washer. The inlet water line 21 from the pump is connected to the side of the exterior or rear cylinder 62 in communication with the interior thereof so that water may then be forced through the line 21 and cylinders 62 and 61.

The inner cylinder 61 of the rinse unit 22 has a tube 71 connected from one side thereof in a loop back to the opposite side thereof in communication with the interior of same and this loop extends about the periphery of the top of the washer interiorly thereof, as generally indicated in FIG. 3. Nozzles 73 are connected to the tube 71 as at the corner bends thereof for spraying water at an angle downwardly and across the wash and rinse chamber of the washer. These nozzles may be advantageously connected to the tube 71 at the corners thereof by flattening the tube on the inner side at the 90° corner bends and welding a threaded washer to such flat surface with an opening then being formed in the tube through the washer so that a small nozzle 73 may be threaded into the washer for spraying high pressure water into the compartment, particularly to rinse and sterilize glasses disposed therein. The tube 71 extends in a closed loop about the top of the washer interiorly thereof and at the front of the washer the tube is snaped into a resilient clip 74 mounted on the top of the under-surface of the washer and being resiliently deformable so that the clip may be deformed to remove the tube engaged thereby. Thus by unloosening the bolt 68 and slipping the loop from the retainer 74 it is possible to remove the entire rinse mechanism 22 from the washer for servicing and the like, if desired.

Figure 5:
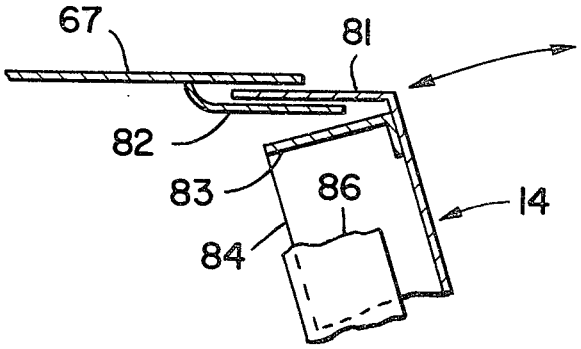
FIG. 5 is a partial detail sectional view of an upper corner of door and washer.

The present invention and particularly the front door 14 thereof is adapted to retain water within the washer without the requirement of rubber gaskets to prevent leakage. Commercial dishwashers that experience heavy use commonly suffer from failure of resilient materials such as rubber of the like employed to seal same, inasmuch as such elements are subject to substantial wear. The present invention provides an angular door closure, as indicated in FIG. 1, with interlocking metal elements which prevent any spray of water from escaping and which furthermore provides for any water that may strike the door or top to drain downwardly interiorly of the washer back into the sump 17. In this respect reference is made to FIG. 5 schematically illustrating engagement of the top of the door 14 with the top 67 of the washer. As noted above, the door 14 is disposed at an angle to vertical when closed and along the top of the door there is provided a horizontal extension or flange 81 which fits underneath the front edge of the top wall 67 of the washer and into a slot formed by a lip 82 which depends from the underside of the top wall 67 of the washer and extends generally horizontally beneath the top flange 81 of the door 14 when the latter is closed. In addition to the foregoing there is provided an inner top plate 83 extending perpendicularly to the door 14 adjacent the top thereof and beneath the top flange 81 so as to be angled inward and downwardly of the washer when the door is closed. This plate 83 will thus be seen to extend underneath of the lip 82 across the top of the door so that any water that may be sprayed into this general area cannot escape in a direct path and will, in fact, strike one of the above-noted elements and drain downwardly along the top plate 83 of the door. The sides of the door are also sealed by the provision of metal side walls 84 which fit into slots in the side of the washer and engage at least the bottom of the slots so that any water that may be sprayed against the door along the sides thereof will drain downwardly in the aforementioned slots 86 to return to the wash and rinse compartment and thence to the sump 17 therein.

Figure 6:
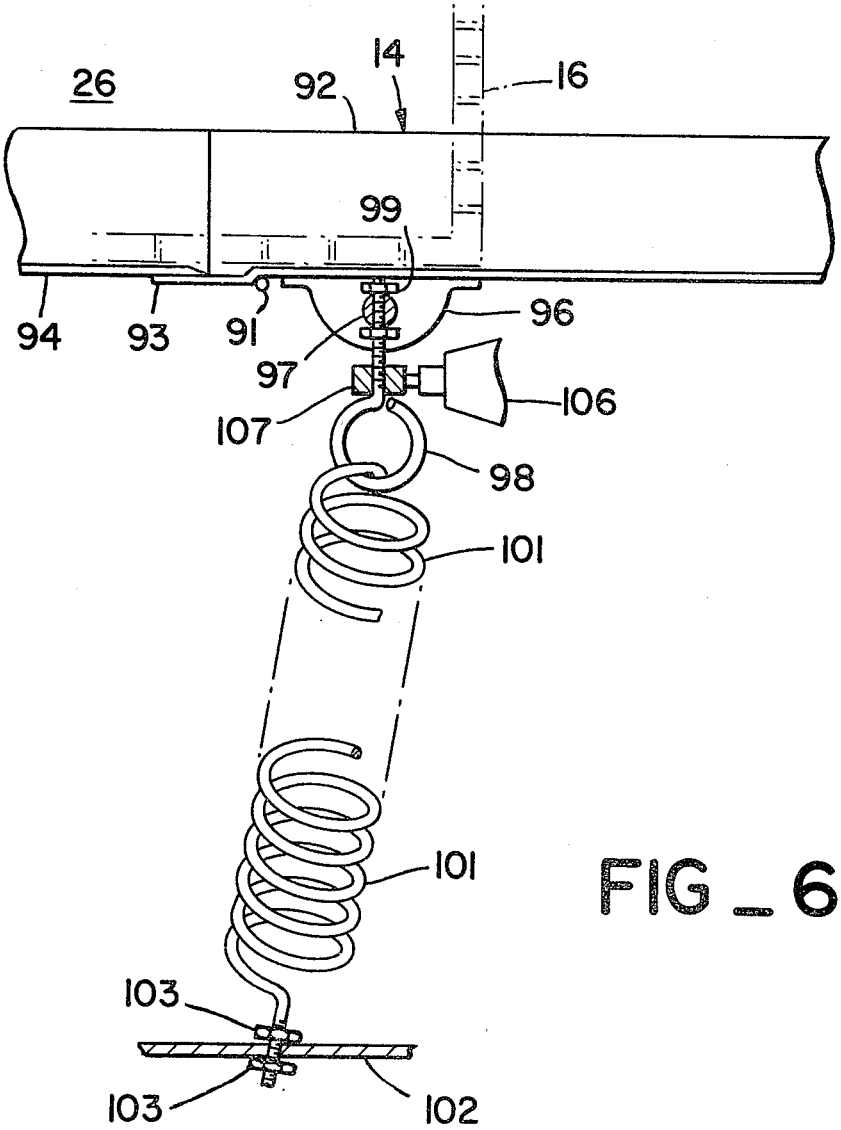
FIG. 6 is a partial schematic representation of the counterbalanced door arrangement.

The improved glass washer and sterilizer of the present invention also includes a counterbalanced door mechanism schematically illustrated in FIG. 6 wherein the door 14 is shown in open position so that same is disposed horizontally after being rotated about a hinge 91 and having side angle plates 92 thereof deformed at the bottom of the door to form lips 93 extending underneath side rails 94 along the sides of the wash and rinse compartment 26 of the washer. A tray 16 is adapted to be placed upon the horizontally disposed door and, after filling, to be slid into the washer and it will be seen that the particular construction illustrated and described above provides for a smooth movement of the tray along the side pieces 92 and 94 of the door and washer with the lip limiting movement of the door to the horizontal position illustrated.

At one side of the door 14 in spaced relation to the hinge there is provided a bracket 96 having a shaft 97 extending therefrom laterally of the door. An eye bolt 98 extends through the outer end of the shaft 97 with lock nuts 99 threaded on the bolt and fixing same to the shaft. A tension spring 101 is connected to the eye bolt 98 and extends downwardly at a small angle to vertical into adjustable connection with a fixed portion 102 of the washer adjacent the bottom thereof and nuts 103 may be threaded on the lower spring connection on opposite sided of the element 102 to adjustably connect the spring at the bottom thereof. The spring 101 is disposed at an angle of about 10° to vertical in the position illustrated in FIG. 6 and as the door is swung closed by pivoting the outer end upwardly the spring is stretched in extension through a vertical position so as to apply a closing force to the door when it is fully engaged with the washer in closed position. There is additionally provided a cut-off switch 106 mounted on a side bracket of the washer and having a push-button actuator located for engagement by an adjustable extension 107 on the eye bolt 98 so as to cut off power to the washer when the door is open.

The present invention operates to spray water and detergent onto glasses disposed in the washing and rinsing compartment hereof by a relatively conventional rotary mounted spray arm disposed beneath the side rails of the washer which are adapted to support the tray of glasses. Water is heated in the tank 28 under control of the control unit 31 and these control means also operate a valve in the tank 28 to controllably discharge water under pressure in the tank to the line 32 into the washing and rinsing compartment. Detergent is automatically added to this water through one of the lines 34 leading from a source of detergent. This water falls into the sump 17 of the washer from whence it is withdrawn via the line 18 and forced through a pump to the above-noted spray arm. At the end of this wash cycle the control unit 31 energizes the solenoid 47 to drive the push rod 48 rapidly upward so that it strikes the underside of the cap 46 on the valve cylinder 41 to raise this cylinder and unseat same from the valve seat 43. This opens the large discharge line 44 so that the water in the sump rapidly drains from the sump to the auxiliary tank 57 whereat it may slowly dissipate into the sewer through the line 58. The flange 59 about the valve cylinder 41 prevents this cylinder from flying upwardly when struck by the solenoid push bar 48. Water in the sump 17 very rapidly drains therefrom and the solenoid is then de-energized so that the cylinder 41 slides downwardly, as directed by the engagement of cylinders 52 and 49 to reseat the valve. Rinse water is then discharged from the tank 28 through the line 32 into the washing and rinsing compartment, with a sterilizer and rinse aid being applied to this rinse water through lines 34. Small pumps such as cystolic pumps may be employed under the control of the control unit 31 to feed detergent, sterilizing agent and rinse aid into water at appropriate times that same are discharged into the washer hereof. Rinse water is withdrawn from the sump 17 by the pump of the present invention and forced through the spray arm and upper rinse mechanism 52 through the line 21. It will be appreciated that the bottom of the wash and rinse compartment of the present invention is inclined toward the sump 17 so that water rapidly drains into the sump whereat it may be recirculated by the pump of the present invention.

At the termination of the rinse cycle the glasses in the tray 16 disposed in the washer are ready to be removed and thus the door 14 may be opened to rest in horizontal position so that the tray may be readily slid out of the wash and rinse compartment onto the door. At this time all circuits of the present invention are deactivated by the switch 106 and a complete cycle of operation is then completed so that the unit is ready to be reloaded. It is noted that at the end of the rinsing and sterilizing cycle of the present invention the valve cylinder 41 may again be raised by the solenoid 47 to dump the rinse water, although alternatively it is possible to employ this rinse water with the addition of detergent as the wash water for the next cycle in order to minimize the use of water herein. It is, however, noted that only a relatively small amount of water is employed in the washing and in the rinsing cycles, i.e., only slightly over one gallon of water is sufficient to wash the complete tray of glasses and a similar amount of water is adequate to rinse a completely tray of glasses. The present invention is also quite advantageous in being adapted for under-the-counter installation including the particular upper rinse unit 22, as described above. It is further noted that various conventional features of washing and rinsing machines for dishes and glasses are not illustrated nor particularly described herein as they are well known in the art.

Figure 7:
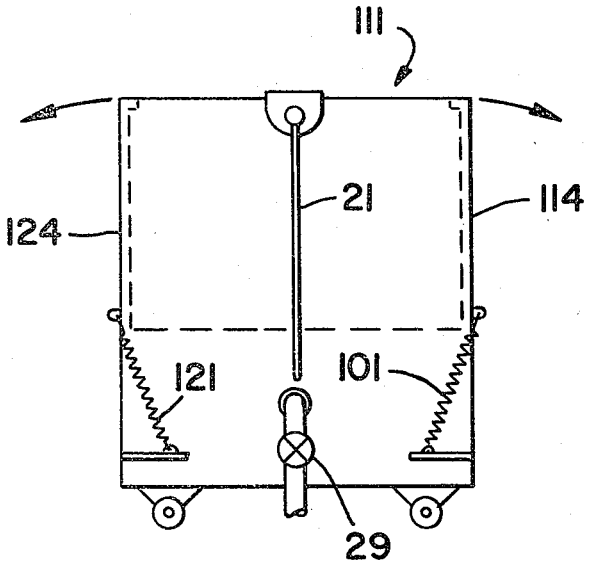
FIG. 7 is a schematic representation of a double door embodiment of the present invention.

The Glass Washer and Sterilizer of the present invention may also be constructed to accommodate loading and/or unloading from either the front or back thereof. For certain applications of devices of the present type, it is convenient to provide for the loading of glasses and the like from one side of a counter as by a waiter, waitress, bushboy or the like and unloading of the device from the opposite side of the counter as by a bartender or other type of attendant. Under the circumstances wherein counter width limits the size of the unit, it is preferrable for the foregoing capability to form the washer and sterilizer with vertical doors, as illustrated in FIG. 7 of the drawings. Referring to this illustration there will be seen to be provided a unit 111 which is substantially the same as unit 11 described above, but which is modified to the extent required for double door operation. Piping, such as the discharge 29, rinse line 21 and associated connections, and inlet lines, may be provided on the side of the unit rather than the back. The front of the unit is provided with a front door 114 which in this instance is vertically disposed in closed position with a counterbalanced door mechanism including a spring 101. The door is held closed by this spring which may be mounted in the same manner as described above with the bottom thereof displaced inwardly of the unit from the hinge of the door. Door operation is quite similar to that described above.

The double door unit 111 of FIG. 7 includes a rear door 124 which may be identical to the front door 114 but provided upon the rear face of the unit. This door 124 is also hinged to swing between a vertical closed position, as illustrated, and a horizontal open position with a counterbalanced door mechanism including a spring 121 operating to hold the door closed. A tray 16 adapted to carry glasses or the like may be slid into or out of either of the doors 114 and 124 with the tray then substantially filling the interior of the unit across the bottom of the wash and rinse compartment therein. The interior of the double door unit 111 may be substantially identical to that of the unit 11 described above and illustrated in FIGS. 1 through 5. This unit does not occupy any more space beneath a counter than the unit 111 and yet provides the additional capability of loading and unloading from either the front or back of the unit. Only minor modification of the unit 11 is necessary in order to produce the unit 111 and this, of course, is highly advantageous insofar as minimizing cost of construction and extension of applicability of the invention.

It will be appreciated by those skilled in the art that the present invention is capable of numerous modifications and variations within the spirit of the present invention and thus it is not intended to limit the invention to the precise terms of description or details of illustration.

What is claimed is:

1. An improved washer and sterilizer having a housing defining a wash and rinse compartment with a sump at the bottom thereof comprising a large discharge pipe extending from the bottom of said pump and having a valve seat about the top thereof, a hollow cylinder disposed in said sump and having an open tapered bottom for engaging said valve seat and a cap mounted in spaced relation to the open top thereof, a solenoid disposed below said sump and discharge and having a push rod extending upwardly through a first fixed tube slidably disposed in a second tube depending from said cap for striking said cap to raise said cylinder upon solenoid actuation, and an external flange about said cylinder above the tapered lower end thereof for damping upward movement of said cylinder by movement of the flange through water in said sump.

2. The washer and sterilizer of claim 1 further defined by a rinse unit having a tube extending in a closed loop from an inner hollow cylinder having an open glanged end communicating with an opening in a back wall of said housing adjacent the top thereof, an outer hollow cylinder having a flange about an open end communicating with the interior of said outer cylinder through a side thereof, a bolt having a head engaging a closed end of said inner cylinder and a shank extending through both of said cylinders into threaded engagement with an outer closed end of said outer cylinder for clamping said flanged cylinders against said back wall, nozzles mounted through said tube in spaced relation about said loop for spraying water into said wash and rinse compartment, and a spring clip secured to the interior of said housing for engaging said loop to support same whereby said loop may be removed by unthreading said bolt and slipping said loop from said clip.

3. The washer and sterilizer of claim 2 further defined by said loop being rectangular and said nozzles being disposed in the corners thereof with a threaded washer being secured to a flattened tube portion at each corner and a nozzle threaded therein for communicating with the tube interior through a mating tube opening.

4. The washer and sterilizer of claim 1 further defined by said washer having a front door pivoted at the bottom thereof and inclined with respect to vertical in closed position, said door having a top flange adapted to fit substantially horizontally into a slot along the top front of the housing and having an inclined plate beneath said flange directed down and inwardly of the housing in closed door position for sealing the top of the door against water spray without resilient sealing means.

5. The water and sterilizer of claim 1 further defined by a front door on said housing having a bottom pivot and adapted to swing past vertical into an inclined closed position, a spring connected to said door in spaced relation to said pivot and extending downwardly and inwardly of said housing in open horizontal position of said door and exerting a closing force on said door in inclined closed position.

6. The washer and sterilizer of claim 5 further defined by an electrical switch having an operator extending into position for engagement with an extension on said in open door position to deactivate water spray in said washer and sterilizer.

7. The washer and sterilizer of claim 1 further defined by front and back doors on said housing pivotally mounted at the bottom of each door for swinging between vertical closed position and horizontal open position; and a pair of counterbalance door mechanisms connected one to each door and each including an inclined tension spring for resiliently holding said doors in either closed or open position whereby said housing may be loaded and unloaded from both front and back.

* * * * *